US010092154B2

(12) United States Patent
Chen

(10) Patent No.: US 10,092,154 B2
(45) Date of Patent: Oct. 9, 2018

(54) AUTOMATIC FLOOR MOPPING DEVICE WITH DRIVING WORM ARRANGED TRANSVERSELY

(71) Applicant: Yuyao Jingcheng high&new technology Co., Ltd, Yuyao (CN)

(72) Inventor: Guozhang Chen, Yuyao (CN)

( * ) Notice: Subject to any disclaimer, the term of this patent is extended or adjusted under 35 U.S.C. 154(b) by 309 days.

(21) Appl. No.: 15/139,316

(22) Filed: Apr. 26, 2016

(65) Prior Publication Data

US 2016/0235269 A1 Aug. 18, 2016

Related U.S. Application Data

(63) Continuation of application No. PCT/CN2014/076092, filed on Apr. 24, 2014.

(30) Foreign Application Priority Data

Nov. 28, 2013 (CN) ..... 2013 1 0656341

(51) Int. Cl.
*A47L 11/28* (2006.01)
*A47L 11/40* (2006.01)

(52) U.S. Cl.
CPC ..... *A47L 11/28* (2013.01); *A47L 11/4061* (2013.01); *A47L 11/4066* (2013.01);
(Continued)

(58) Field of Classification Search
CPC .. A47L 11/28; A47L 11/4061; A47L 11/4066; A47L 11/4069; A47L 11/4072; A47L 2201/04
(Continued)

(56) References Cited

U.S. PATENT DOCUMENTS 3,822,433 A * 7/1974 Krekler ..... A47L 11/282 15/260
8,382,906 B2 * 2/2013 Konandreas ..... A22C 17/0013 134/21

(Continued)

*Primary Examiner* — Weilun Lo
(74) *Attorney, Agent, or Firm* — Wayne & Ken, LLC; Tony Hom

(57) ABSTRACT

An automatic mopping device with a driving worm arranged transversely includes an upper covering plate, an outer shell, a transmission member, an electrical component, a bottom cover, a chassis and a mopping ring assembly, and further includes a gear ring securing turntable, a mounting base and a motor cover. The overall height of the mopping device is between 60-64 mm, and the transmission member includes 2 wheels whose width is between 8-15 mm. The transmission member further comprises a perpendicularly arranged worm A and a horizontally arranged worm wheel B, a cylindrical spur gears A, B, C, a duplex gear and an internal gear ring. The duplex gear includes a cylindrical spur gear D and a planet gear. The worm wheel A and worm B are respectively meshed with the driving worm. The gear ring securing turntable is immovably connected to the internal gear ring, while the internal gear ring is meshed with the planet gear. The chassis is immovably connected to the gear ring securing turntable. The present invention has the following advantages: it is not that sensitive to the softness/hardness or the roughness/smoothness of the floor due to its relatively narrow wheels, thus avoiding breakdown, and its overall height is low enough to operate automatically underneath bed and table.

5 Claims, 4 Drawing Sheets

(52) U.S. Cl.
CPC ..... *A47L 11/4069* (2013.01); *A47L 11/4072* (2013.01); *A47L 2201/04* (2013.01)

(58) Field of Classification Search
USPC ..... 15/98
See application file for complete search history.

(56) References Cited

U.S. PATENT DOCUMENTS

| | | | | |
|---|---|---|---|---|
| 8,898,844 | B1 * | 12/2014 | Dooley | A47L 11/10 15/319 |
| 9,615,714 | B2 * | 4/2017 | Jang | A47L 11/4061 |
| 9,775,485 | B2 * | 10/2017 | Scholten | A47L 11/24 |
| 2006/0288519 | A1 * | 12/2006 | Jaworski | A47L 11/28 15/340.1 |
| 2011/0136418 | A1 * | 6/2011 | Weder | A47L 11/4069 451/353 |
| 2011/0191976 | A1 * | 8/2011 | Yan | A47L 11/4002 15/319 |
| 2014/0223678 | A1 * | 8/2014 | Chiu | A47L 11/4066 15/98 |
| 2014/0373302 | A1 * | 12/2014 | Hsu | A47L 9/009 15/300.1 |
| 2015/0026920 | A1 * | 1/2015 | Hsu | A47L 11/4066 15/403 |
| 2015/0190028 | A1 * | 7/2015 | Yan | A47L 11/4072 15/49.1 |
| 2016/0007817 | A1 * | 1/2016 | Schlischka | A47L 11/4061 280/5.514 |

* cited by examiner

AUTOMATIC FLOOR MOPPING DEVICE WITH DRIVING WORM ARRANGED TRANSVERSELY

CROSS-REFERENCE TO RELATED APPLICATIONS

This application is a continuation of International Patent Application No. PCT/CN2014/076092 with an international filing date of Apr. 24, 2014, designating the United States, now pending, and further claims priority benefits to Chinese Patent Applications No. 201310656341.X, filed Nov. 28, 2013. The contents of all of the aforementioned applications, including any intervening amendments thereto, are herein incorporated by reference.

TECHNICAL FIELD

The present invention relates to a floor mopping device, especially to an automatic floor mopping device with a driving worm arranged transversely, which relates to the technical field of mechanical floor cleaner.

BACKGROUND ART

As the intelligent appliances such as robot vacuum and robot cleaner and the like become popular, more and more people, especially the elderly living alone, use intelligent appliances to clean floor instead of working manually in order to release their working pressure and improve their living quality. With the development of science and technology, intelligent household automatic cleaning machine begins to appear. The overall height of the current products, however, is unable to be reduced to an ideal level so that they cannot reach underneath the low furniture during operating, thus the cleaning work can't be done throughout the whole room, a lot of blind spots are left which leads to unnecessary regret. Also, since the width of the wheels required for advancing is relatively large, the wheels are so sensitive to softness/crudeness degree of the floor that they can't be normally and automatically operated on high friction floor.

SUMMARY OF INVENTION

In order to overcome the disadvantages of the above-mentioned automatic floor cleaning machines that include they are too high to clean under low furniture and the width of the wheels is too thick to operate normally on the floor with large friction, the object of the present invention is to provide an automatic floor mopping device with a driving worm arranged transversely, which can both reduce the height of the device so as to be able to clean underneath low furniture and narrow the thickness of the wheels in order to operate normally on the floor with large friction.

In order to realize the above objects, the present invention adopts the following technical means: an automatic mopping device with a driving worm arranged transversely (hereinafter is called as "mopping device" for short), includes an upper cover plate, an outer shell, a transmission member, an electrical component, a bottom cover, a chassis and a mopping ring assembly. The transmission member comprises a driving mechanism, a mopping advancing mechanism and a mopping ring rotating mechanism. The driving mechanism includes a driving motor and a motor shaft, and the mopping advancing mechanism includes a driving shaft and two wheels which are connected to the two ends of the driving shaft respectively. The electric component includes a charging system and a switch assembly.

The automatic mopping device also includes a gear ring securing turntable, a mounting base and a motor cover.

The driving mechanism further includes a driving worm. The motor shaft and the driving worm are coaxial set and arranged horizontally, wherein the driving worm is arranged at the front end of the motor shaft and integrated with the motor shaft. The mopping ring rotating mechanism is arranged on the same plane with the driving mechanism.

The advancing mechanism further includes a worm wheel A. The mopping ring rotating mechanism comprises a worm wheel B, a cylindrical spur gear A, a cylindrical spur gear B, a cylindrical spur gear C, a duplex gear and an internal gear ring, the duplex gear includes a cylindrical spur gear D and a planet gear, and the planet gear is placed below the cylindrical spur gear D, the overall height of the mopping device is between 60-64 mm, and the width of each wheel is between 8-15 mm.

The worm wheel A is perpendicularly arranged under the driving worm, and mounted on the driving shaft via its central bore. The worm wheel A is meshed with the driving worm. The worm wheel B is horizontally arranged on one side of the driving worm and meshed with the driving worm. The cylindrical spur gear A, the cylindrical spur gear B, the cylindrical spur gear C, and the cylindrical spur gear D are successively meshed one by one, while the planet gear 3112 is meshed with the internal gear ring 312.

The mounting base is arranged above the transmission member. The gear ring securing turntable is arranged above both the mounting base and the internal gear ring. The gear ring securing turntable is a tight fit to the internal gear ring. The motor cover is arranged beneath the transmission member. The shaft A, the shaft B, the shaft C, and the shaft D are all arranged on the mounting base and pressed into the mounting base. The shaft A, the shaft B, the shaft C, and the shaft D are respectively passed through and formed a clearance fit with the cylindrical spur gear A, the cylindrical spur gear B, the cylindrical spur gear C and the duplex gear, thus they can be rotated together.

Screw perforations are arranged on the outer side of the gear ring securing turntable. And fixing rods are arranged on the chassis. The number of the screw perforations and the fixing rods is same. Thus the chassis and the gear ring securing turntable are connected together via the fixing rods and the screw perforations.

The overall height of the mopping device is between 60-64 mm, and the width of each wheel is between 8-15 mm. In an exemplary embodiment, the overall height of the automatic mopping device is 62 mm, and the width of the wheel 304 is 10 mm.

The outer shell is arranged above the gear ring securing turntable, the electrical component is immovably arranged at the middle portion of the outer shell, the upper cover plate is arranged above the electrical component.

The mopping ring assembly is arranged beneath the chassis. And the chassis includes 6 small magnets and 8 steel balls. The mopping ring assembly further includes 6 iron sheets. The 6 small magnets are evenly arranged on the chassis, and the 6 iron sheets are evenly arranged on the mopping ring assembly. The positions of the small magnets correspond to those of the iron sheets respectively, so that the mopping ring assembly and the chassis are attracted together by permanent magnets.

The 8 steel balls are embedded into and evenly distributed on the chassis, circumferentially blocking along the outer periphery of the mounting base in order to prevent the inclination of the mounting base and the scraping between the mounting base and the internal gear ring, thus the stability of the mounting base is improved.

The gear ring securing turntable includes a central bore, and a bearing is arranged between the mounting base and the central bore so as to lower the resistance generated by the mounting base 9 during the rotation of the mopping device.

Compared to the prior art, the present invention has the following advantages:

(1) Due to the fact that both of the motor shaft and the driving worm of the mopping device are transversely arranged, and also both of the rotating mechanism and the driving mechanism are designed to be on the same plane, the overall height of the mopping device is low enough to be adapted to clean the underneath of table, bed and other easily neglected corners, thus the device can bring a more comfortable and clean environment to the modern family life.

(2) Current automatic floor cleaning devices have relatively thick wheels, which can cause breakdown when working on floor with large friction so they often require manual help to return normal working state. While the device of present invention has relatively thin wheels and therefore the contact area between the wheels and the floor is relatively small, so it is not sensitive to the softness/roughness degree of the floor, accordingly it can work normally since the breakdown will not occur on the floor with large friction.

(3) Since the mopping ring assembly is connected to the main body via the attraction of permanent magnet, the structure of the mopping device of present invention can be assembled/disassembled simply and conveniently.

THE DESCRIPTION OF REFERENCE NUMBERS

Figure 1:
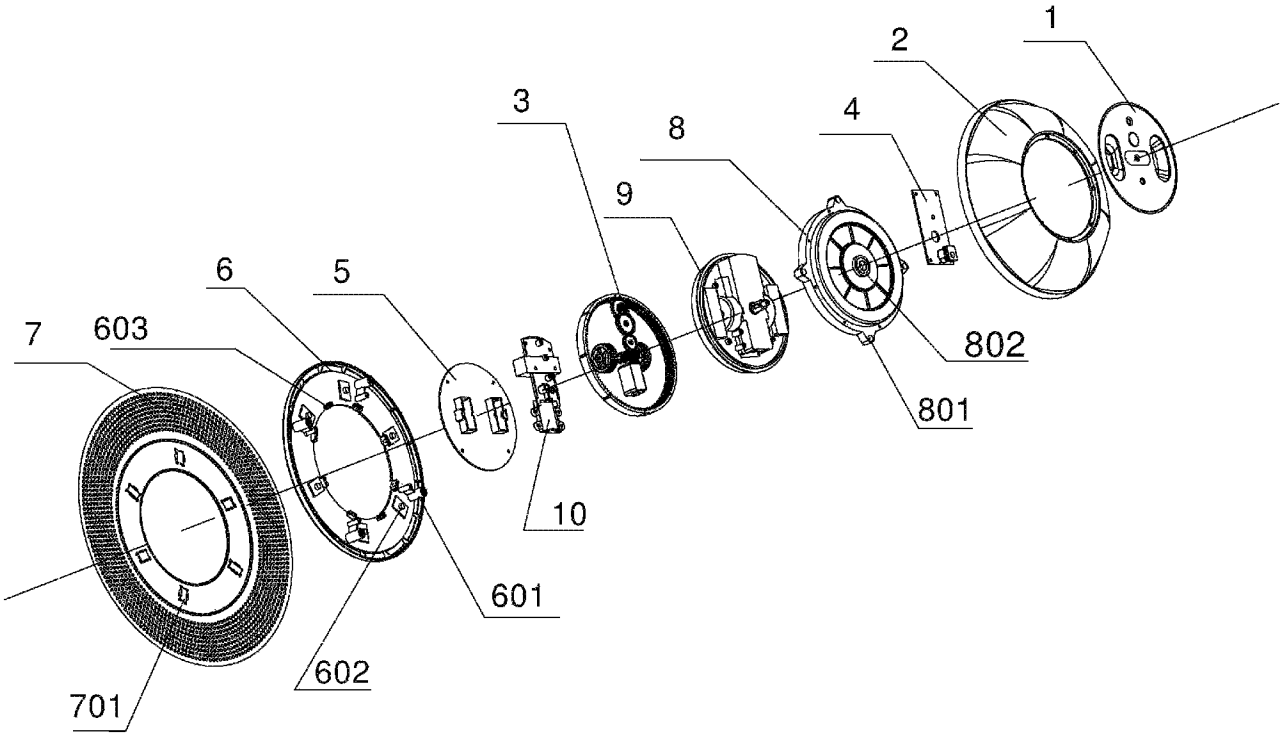
FIG. 1 is the exploded view of the mopping device according to an embodiment of the present invention.

1 upper cover plate
2 outer shell
3 transmission member
301 driving motor
302 motor shaft
303 driving shaft
304 wheels
305 driving worm
306 driving worm wheels
307 driving worm wheels B
308 cylindrical spur gear A
309 cylindrical spur gear B
310 cylindrical spur gear C
311 duplex gear
3111 cylindrical spur gear D
3112 planet gear
312 internal gear ring
4 electric component
5 bottom cover
6 chassis
601 fixing rod
602 small magnet
603 steel ball
7 mopping ring assembly
701 iron sheets
8 gear ring securing turntable
801 screw perforation
802 central shaft bore
9 mounting base
901 shaft A
902 shaft B
903 shaft C
904 shaft D
10 motor cover

EMBODIMENT

The following detailed description is discussed with the reference to the figures and embodiments, but it should not be regarded as the limitation to the present invention.

Figure 2:
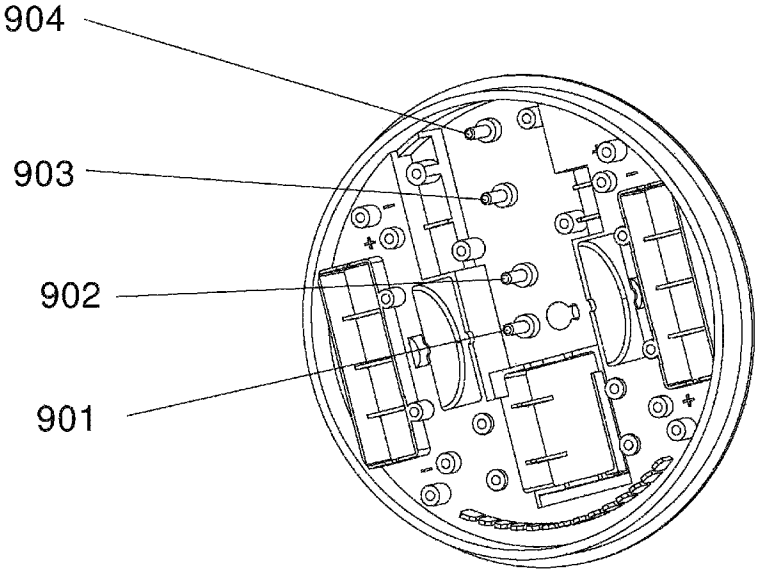
FIG. 2 is the schematic view of the mounting base and shaft A, B, C, and D.
Figure 3:
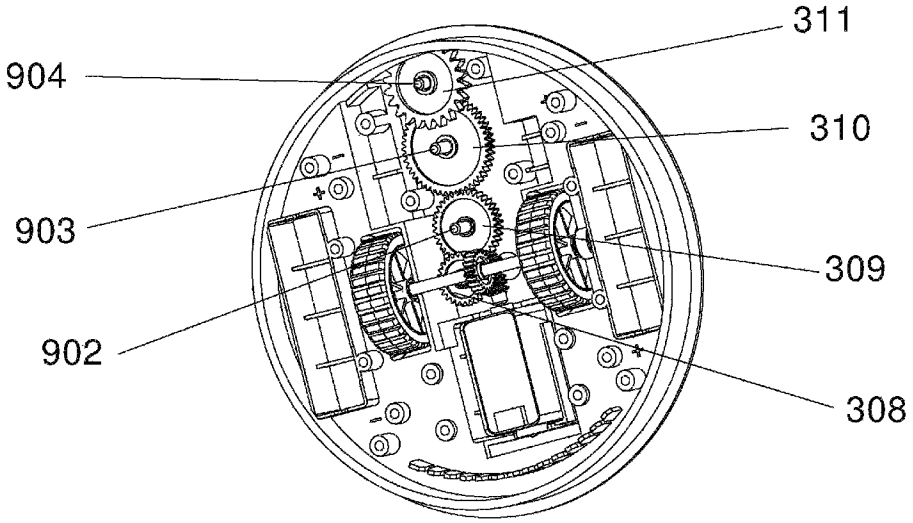
FIG. 3 is the schematic view of the cylindrical spur gear A, B, C and the duplex gear with shaft A, B, C, D and the mounting base.
Figure 4:
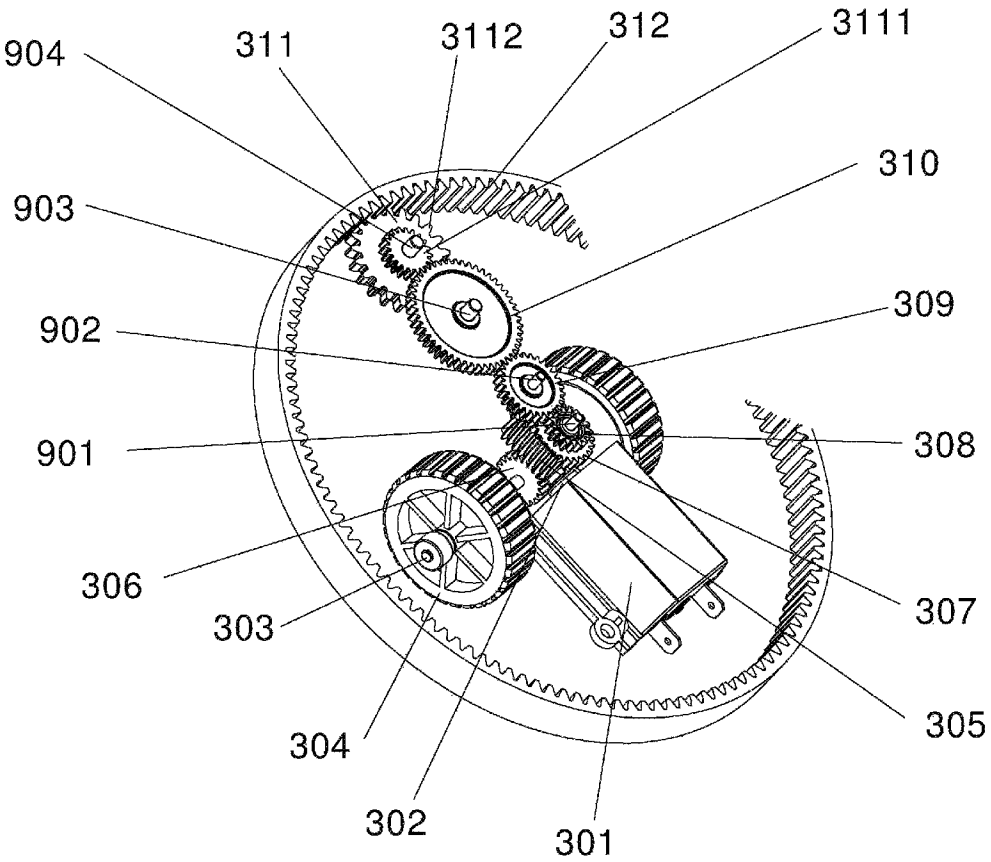
FIG. 4 is the enlarged view of the transmission members.

Referring to the FIGS. 1 to 4, an automatic mopping device with a driving worm arranged transversely (hereinafter is called as "mopping device" for short), includes an upper cover plate 1, an outer shell 2, a transmission member 3, an electric component 4, a bottom cover plate 5, a chassis 6 and a mopping ring assembly 7. The transmission member 3 includes a driving mechanism, an advancing mechanism and a mopping ring rotating mechanism. The driving mechanism includes a driving motor 301 and a motor shaft 302. The advancing mechanism includes a driving shaft 303 and two wheels 304 which are fixed on the two ends of the driving shaft 303 respectively. The electric component 4 includes a charging system and a switch assembly.

The mopping device further includes a gear ring securing turntable 8, a mounting base 9 and a motor cover 10.

The driving mechanism further includes a driving worm 305. The motor shaft 302 and the driving worm 305 are coaxial set and arranged horizontally, wherein the driving worm 305 is arranged at the front end of the motor shaft 302 and integrated with the motor shaft 302. The mopping ring rotating mechanism is arranged on the same plane with the driving mechanism.

The advancing mechanism of the mopping device further includes a worm wheel A 306. The mopping ring rotating mechanism includes driving worm wheels B 307, a cylindrical spur gear A 308, a cylindrical spur gear B 309, a cylindrical spur gear C 310, a duplex gear 311 and an internal gear ring 312. The duplex gear 311 includes a cylindrical spur gear D 3111 and a planet gear 3112, wherein the planet gear 3112 is arranged beneath the cylindrical spur gear D 3111. The overall height of the mopping device is between 60-64 mm, and the width of each wheel is between 8-15 mm. In an exemplary embodiment, the overall height of the automatic mopping device is 62 mm, and the width of the wheel 304 is 10 mm.

The worm wheel A 306 is perpendicularly arranged under the driving worm 305, and mounted on the driving shaft 303 via its central bore. The worm wheel A 306 is meshed with the driving worm 305.

The worm wheel B 307 is horizontally arranged on one side of the driving worm 305 and meshed with the driving worm 305. The cylindrical spur gear A 308, the cylindrical spur gear B 309, the cylindrical spur gear C 310, and the cylindrical spur gear D 3111 are successively meshed one by one, while the planet gear 3112 is meshed with the internal gear ring 312.

The mounting base 9 is arranged above the transmission member 3. The gear ring securing turntable 8 is arranged above both the mounting base 9 and the internal gear ring 312. The gear ring securing turntable 8 is a tight fit to the internal gear ring 312. The motor cover 10 is arranged beneath the transmission member 3. The shaft A 901, the shaft B 902, the shaft C 903, and the shaft D 904 are all arranged on the mounting base 9 and pressed into the mounting base 9. The shaft A 901, the shaft B 902, the shaft C 903, and the shaft D 904 are respectively passed through and formed a clearance fit with the cylindrical spur gear A 308, the cylindrical spur gear B 309, the cylindrical spur gear C 310 and the duplex gear 311, thus they can be rotated together.

Screw perforations 801 are arranged on the outer side of the gear ring securing turntable 8. And fixing rods 601 are arranged on the chassis 6. The number of the screw perforations 801 and the fixing rods 601 is same. Thus the chassis 6 and the gear ring securing turntable 8 are connected together via the fixing rods 601 and the screw perforations 801. In an embodiment of FIG. 1, there are 4 screw perforations 801 and 4 fixing rods 601.

The outer shell 2 is arranged above the gear ring securing turntable 8. The electric component 4 is immovably arranged at the middle of the outer shell 2. The upper cover plate 1 is arranged above the electric component 4.

The mopping ring assembly 7 is arranged beneath the chassis 6. And the chassis 6 includes 6 small magnets 602 and 8 steel balls 603. The mopping ring assembly 7 further includes 6 iron sheets 701. The 6 small magnets 602 are evenly arranged on the chassis 6, and the 6 iron sheets 701 are evenly arranged on the mopping ring assembly 7. The positions of the small magnets 602 correspond to those of the iron sheets 701 respectively, so that the mopping ring assembly 7 and the chassis 6 are attracted together by permanent magnets.

The 8 steel balls 603 are embedded into and evenly distributed on the chassis 6, circumferentially blocking along the outer periphery of the mounting base 9. They can be rotated freely.

The gear ring securing turntable 8 includes a central bore 802. A bearing is arranged between the mounting base 9 and the central bore 802 so as to lower the resistance generated by the mounting base 9 during the rotation of the mopping device.

When the driving motor 301 is actuated, the motor shaft 302 drives the driving worm 305 to rotate, then the driving worm 305 drives the worm wheel A 306 to rotate, after that the worm wheel A 306 drives the shaft 303 to rotate, and meanwhile drives the two wheels 304 to rotate, therefore the automatic mopping device can be advanced forward. At the meantime, the driving worm 305 drives the driving worm wheel B 307 to rotate, and then the driving worm wheel B 307 successively drives the cylindrical spur gear A 308, 8309, C 310 and the duplex gear D 311 to rotate, next, the duplex gear D 311 drives the internal gear ring 312 and the gear ring securing turntable 8 to rotate. After that, the gear ring securing turntable 8 brings the chassis 6 to turn. At last the chassis 6 drives the mopping ring assembly 7 to rotate together, thus the mopping is working.

During the normal working, the internal gear ring 312 rotates, and meanwhile the gear ring securing turntable 8, the chassis 6, the mopping ring assembly 7, and the outer shell 2 also rotate. When the mopping ring assembly 7 cannot turn due to a wall or other obstructions, the internal gear ring 312 stops rotating, while the planet gear 3112 starts to rotate along the inner circle of the internal gear ring 312. Thus, in the transmission member 3, all of the other transmission members except the internal gear ring 312 start to rotate along the inner circle of the internal gear ring 312, meanwhile driving the mounting base 9, the motor cover 10, the upper cover plate 1, and the electric component 4 to rotate, and then the advancing direction of the wheels 304 is changed accordingly.

The embodiments described above are merely the preferred embodiment of the present invention, and the person skilled in the art can change or alternate the present invention without departure of the claimed scope of the present invention.

I claim:

1. An automatic mopping device including an upper cover plate, an outer shell, a transmission member, an electrical component, a bottom cover, a chassis, a mopping ring assembly, a gear ring securing turntable, a mounting base, and a motor cover;

the transmission member comprising a driving mechanism, a mopping advancing mechanism and a mopping ring rotating mechanism;

the driving mechanism includes a driving motor, a motor shaft, and a driving worm; wherein the driving worm is integrated with and arranged at the front end of the motor shaft and is coaxial therewith, the motor shaft and the driving worm are arranged horizontally;

the mopping advancing mechanism includes a driving shaft and two wheels which are connected to the two ends of the driving shaft respectively, the mopping advancing mechanism further includes a first worm wheel meshed with the driving worm, the first worm wheel is perpendicularly arranged under the driving worm and mounted on the driving shaft via its central bore;

the electric component includes a charging system and a switch assembly;

the mopping ring rotating mechanism is arranged on a same plane with the driving mechanism, the mopping ring rotating mechanism comprises a second worm wheel, a first cylindrical spur gear, a second cylindrical spur gear, a third cylindrical spur gear, a duplex gear and an internal gear ring, the duplex gear includes a fourth cylindrical spur gear and a planet gear, and the planet gear is placed below the fourth cylindrical spur gear, the second worm wheel is horizontally arranged on one side of the driving worm and meshed with the driving worm, the first cylindrical spur gear, the second cylindrical spur gear, the third cylindrical spur gear, and the fourth cylindrical spur gear are successively meshed one by one, while the planet gear is meshed with the internal gear ring;

the mounting base is arranged above the transmission member, the gear ring securing turntable is arranged above both the mounting base and the internal gear ring, the gear ring securing turntable is secured to the internal gear ring through a tight fit, the motor cover is arranged beneath the transmission member; a first shaft, a second shaft, a third shaft, and a fourth shaft are all arranged on the mounting base and pressed into the mounting base; the first shaft, the second shaft, the third shaft, and the fourth shaft pass through and form a clearance fit with the first cylindrical spur gear, the second cylindrical spur gear, the third cylindrical spur gear and the duplex gear, respectively, and are rotatable together; screw perforations are arranged on the outer side of the gear ring securing turntable; fixing rods are arranged on the chassis; the number of the screw perforations and the fixing rods is same; and the chassis and the gear ring securing turntable are connected together via the fixing rods and the screw perforations.

2. The mopping device according to claim 1, wherein the overall height of the mopping device is between 60-64 mm, and the width of each wheel is between 8-15 mm.

3. The mopping device according to claim 1, wherein the outer shell is arranged above the gear ring securing turntable, the electrical component is immovably arranged at a middle portion of the outer shell, the upper cover plate is arranged above the electrical component.

4. The mopping device according to claim 1, wherein the mopping ring assembly is arranged beneath the chassis, the chassis includes six small magnets and eight steel balls, the mopping ring assembly further includes six iron sheets, the six small magnets are evenly arranged on the chassis, and the six iron sheets are evenly arranged on the mopping ring assembly, positions of the small magnets correspond to those of the iron sheets respectively, so that the mopping ring assembly and the chassis are attracted together by permanent magnets.

5. The mopping device according to claim 4, wherein the eight steel balls are embedded into and evenly distributed on the chassis and circumferentially located along the outer periphery of the mounting base.

* * * * *